US007419333B2

(12) United States Patent
Bussey, Jr. et al.

(10) Patent No.: US 7,419,333 B2
(45) Date of Patent: Sep. 2, 2008

(54) DRAINAGE ELEMENT

(76) Inventors: Harry Bussey, Jr., 960 Cape Marco Dr., Unit 1803, Marco Island, FL (US) 33937; Buddy Harry Bussey, III, 4 Windy Hill, Atlantic Highlands, NJ (US) 07716

( * ) Notice: Subject to any disclaimer, the term of this patent is extended or adjusted under 35 U.S.C. 154(b) by 213 days.

(21) Appl. No.: 11/248,754

(22) Filed: Oct. 12, 2005

(65) Prior Publication Data

US 2007/0081859 A1 Apr. 12, 2007

(51) Int. Cl.
*E02B 11/00* (2006.01)

(52) U.S. Cl. ..... 405/50; 405/302.6; 405/302.7; 156/293

(58) Field of Classification Search ..... 405/302.6, 405/302.7, 50; 156/556, 293; 53/451
See application file for complete search history.

(56) References Cited

U.S. PATENT DOCUMENTS

| | | | | | |
|---|---|---|---|---|---|
| 3,996,721 | A * | 12/1976 | Mercer | 53/449 |
| 4,322,929 | A * | 4/1982 | Neumann | 53/451 |
| 5,100,258 | A * | 3/1992 | VanWagoner | 405/45 |
| 5,356,007 | A * | 10/1994 | Feldt | 53/444 |
| 5,419,659 | A * | 5/1995 | Mercer | 405/302.7 |
| 5,452,968 | A * | 9/1995 | Dlugosz | 405/302.7 |
| 5,535,499 | A * | 7/1996 | Houck et al. | 53/471 |
| 5,595,652 | A * | 1/1997 | Rainer | 210/282 |
| 5,823,683 | A * | 10/1998 | Antonacci et al. | 383/107 |
| 6,185,908 | B1 * | 2/2001 | Madderom | 53/451 |
| 6,547,493 | B2 * | 4/2003 | Spangler et al. | 405/302.6 |
| 6,848,866 | B1 * | 2/2005 | McGinn | 405/302.6 |
| 6,921,484 | B2 * | 7/2005 | Engwer | 405/302.7 |
| 7,008,144 | B2 * | 3/2006 | McGinn | 405/302.6 |
| 2003/0031511 | A1 * | 2/2003 | Tyler | 405/302.6 |
| 2005/0236315 | A1 * | 10/2005 | McPhillips | 210/205 |
| 2007/0003369 | A1 * | 1/2007 | Hanson et al. | 405/19 |

* cited by examiner

*Primary Examiner*—Frederick L Lagman
(74) *Attorney, Agent, or Firm*—Francis C. Hand; Carella, Byrne, Bain et al.

(57) ABSTRACT

The machine for making the drainage elements employs a forming collar about the delivery chute for the aggregate so as to form a continuously supplied strip of netting into a tube to receive the aggregate. The machine may be run on an automatic basis without a need to stop the machine in order to replenish the supply of netting. A pair of tapes are used to secure the longitudinal edges of the tape together, one tape located inside the tube and the other tape located outside the tube.

16 Claims, 3 Drawing Sheets

DRAINAGE ELEMENT

This invention relates to a drainage element and to a method and machine for making the same. More particularly, this invention relates to method and apparatus for making drainage elements with a tubular netting and aggregate.

As is known, drainage elements have been constructed of a perforated plastic pipe surrounded by loose aggregate, such as foam plastic elements, beads, and other lightweight materials. Also, various techniques have been known for making such drainage elements in a manufacturing plant so that the individual drainage elements may then be shipped to a construction site for use. Examples of such techniques are described in U.S. Pat. Nos. 5,015,123; 5,154,543; 5,535,499; 5,657,527; and 6,173,483. Generally, these techniques use a process in which a supply of aggregate is fed under gravity into a horizontally disposed tubular mandrel through which a corrugated pipe is passed horizontally and on which a length of netting is mounted and fed off the mandrel as the aggregate fills the netting. In some embodiments, the aggregate is pneumatically conveyed into the netting while a reciprocating frame is provided for feeding the netting from a sleeve.

One of the drawbacks of this type of technique is that the length of the netting that is fed off the tubular mandrel is limited. Further, the apparatus, as described, requires a positive means for feeding the netting from the mandrel in order to prevent the netting from narrowing and becoming frictionally engaged with the outer surface of the mandrel.

Another drawback for this type of apparatus is that the apparatus requires an expenditure of energy to drive the loose fill material horizontally into the sleeve of netting.

Further, the drainage elements that are made in accordance with these techniques have been relatively flexible. As a result, drainage elements that are of long lengths, for example ten feet or more, run a risk of the netting catching on equipment in the field and becoming torn. In such cases, there is a risk that the aggregate within the netting may spill out. Where the netting is made of thin filaments so that the netting may be bunched up on the mandrel, there is also the risk of the filaments bursting to an extent that the aggregate can spill out of the drainage element.

Accordingly, it is an object of this invention to provide an apparatus for making lightweight drainage elements on a substantially continuous basis.

It is another object of the invention to provide a method and apparatus of making drainage elements of compact construction in an inexpensive manner.

It is another object of the invention to provide a drainage element made with an outer netting that is tear-resistant.

It is another object of the invention to provide a drainage element that is relatively rigid.

It is an object of this invention of to provide a simple apparatus for making a composite drainage element of plastic pipe and surrounding lightweight aggregate.

It is another object of the invention to provide a simple technique for placing loose lightweight aggregate about a perforated pipe for making a drainage element.

It is another object of the invention to reduce wear in an apparatus for making drainage elements.

It is another object of the invention to reduce the space required for an apparatus to make composite drainage elements.

It is another object of the invention to fabricate drainage elements of composite construction at a reduced cost.

Briefly, the invention provides a drainage element that is comprised of a tubular netting and a mass of aggregate within the netting.

In one embodiment, the tubular netting is made of a continuous strip of netting that has a pair of edges disposed in overlapping relation to define a tubular cross-section and a pair of tapes that are disposed over the overlapped edges of the netting and that are provided with a layer of adhesive to bond the tapes together while at the same time sandwiching the edges of the netting therebetween in secured relation.

The netting is made of a thermoplastic material that is tear resistant, for example, the netting may be made of polypropylene, such as a polypropylene netting supplied by Conwed of Minneapolis, Minn. under model number R01588-033. Alternatively, the netting may be made of polyethylene.

The tapes are obtained from Sure Tape of Hickory, N.C. under model number HP100. The adhesive on the tapes is a pressure sensitive non-releasable type.

The aggregate that is employed in the drainage element may be a loose fill, plastic material or any other suitable aggregate.

The invention provides a method of making a drainage element that comprises the first step of forming a continuous longitudinal strip of netting into a tubular cross-section about a chute through which a flow of aggregate is passed. The strip is formed with a pair of longitudinal edges disposed in overlapping relation to each other. Once the tube is formed, a pair of tapes is adhesively secured over the edges of the netting inside and outside the tube in order to secure the overlapped edges of the netting together. In this respect, each tape has a layer of adhesive that becomes bonded to the adhesive on the other tape through the open mesh in the netting while also being adhesively secured to the filaments of the netting defining the open meshes. The bonding of the two tapes together serves to sandwich the overlapped edges of the netting together forming a firm secure seal.

As the netting is being formed into a tube, the netting is gathered together at a point downstream of the chute to seal off one end of the tube. Aggregate is then passed through the chute and into the tube in a conventional manner. After a determined length of tube has been filled, the netting is again gathered together to seal off a second end of the tube. A series of interconnected drainage elements can thus be fabricated and shipped as such or the drainage elements may be separated from each other by severing the gathered together portions of the netting at a mid-point for individual handling.

The apparatus provided by the invention includes a chute for passing a flow of aggregate therethrough and a forming collar about the chute for shaping a continuously supplied strip of netting into a tubular shape with the longitudinal edges of the netting disposed in overlapping relation. In addition, the apparatus is provided with a first means for supplying a length of tape having an adhesive surface facing outwardly of the chute within the plane of the overlapped edges of the netting and a second means for supplying a second length of tape having an adhesive surface facing inwardly of the chute within the plane of the overlapped edges of the netting and opposite the first length of tape.

The apparatus also provides a means for pressing the two tapes against each other in order to secure the tapes together with the overlapped edges of the netting sandwiched therebetween. In this respect, the netting is made of a mesh material with open meshes through which the adhesive on the two tapes come into contact with each other. At the same time, the adhesive on the tapes bonds to the filaments of the netting forming the mesh openings.

The apparatus also has suitable means spaced from the chute for intermittently gathering and securing the netting to form an end of a drainage element and to contain the aggregate therein.

In another embodiment, a plurality of strips of netting may be supplied from different sources spaced peripherally about the chute, particularly where a large diameter drainage element is to be fabricated. In this embodiment, each strip is disposed peripherally about one part of the chute with the longitudinal edges overlapped with the adjacent strips. Pairs of adhesive tapes are then applied, as above, to secure the overlapped edges of the strips together thereby forming multiple seams along the resulting sleeve of netting.

In still another embodiment, instead of using a pair of adhesive tapes to secure the overlapped edges of the mesh strip or strips together, use may be made of a hot glue with a release liner. For example, a pair of tapes without adhesive may be made of positioned to opposite sides of the overlapped edges of the strip and a hot melt glue may be applied directly to the surface of one of the tapes before the tapes are brought together in facing relation. The tapes may then be pressed together so that the glue bonds the two tapes together to sandwich the edges of the mesh strip therebetween. Where the tapes are made of a suitable material, the tapes may be bonded to each other by means of a heat seal.

The apparatus may be constructed so as to form the drainage elements along a vertical axis, for example in a manner as described in pending patent application Ser. No. 11/106,108 filed Apr. 14, 2005. Likewise, the apparatus may be mounted so that the drainage elements are formed on an angle to the horizontal. Also, the apparatus may be employed so as to form the drainage elements along a horizontal axis.

Where the apparatus is constructed to form a drainage elements along a vertical axis, the aggregate may be fed under gravity or may be fed pneumatically through the chute. Where the apparatus forms a drainage elements along a horizontal axis, mechanical means or pneumatic means may be used to move the aggregate horizontally through the chute.

These and other objects and advantages of the invention will become more apparent from the following detailed description taken in conjunction with the accompanying drawings wherein.

Figure 2:
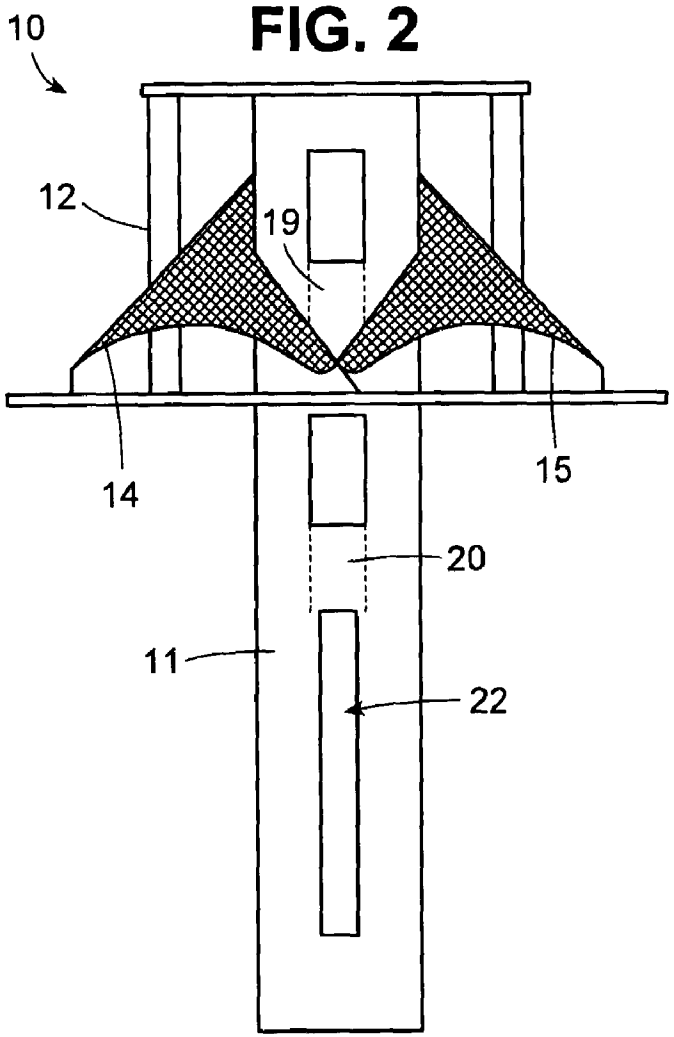
FIG. 2 illustrates a view of the machine of FIG. 1 rotated 90°.
Figure 1:
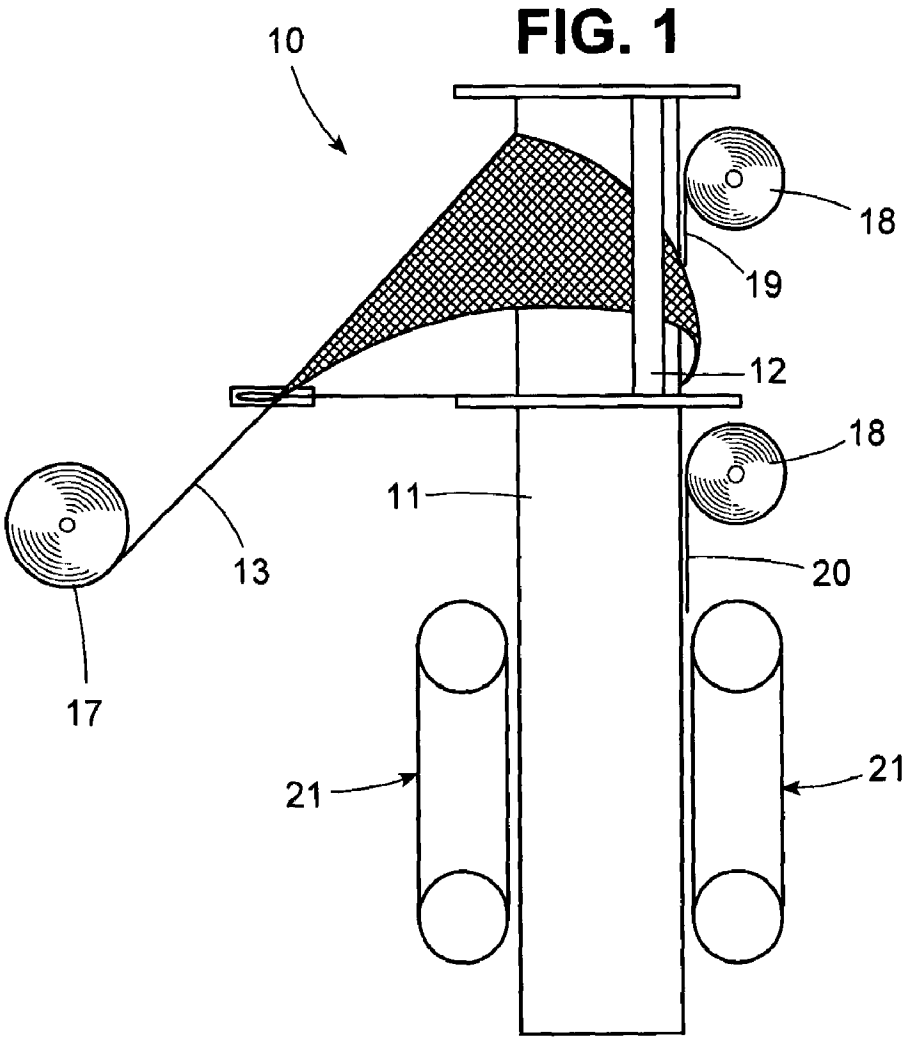
FIG. 1 illustrates a side view of a machine for making a drainage element in accordance with the invention.

Referring to FIGS. 1 and 2, the machine 10 for making a drainage element includes a delivery chute 11 disposed on a vertical axis for passing a flow of aggregate (not shown) therethrough from top to bottom. The aggregate may be supplied in any suitable fashion, for example, the aggregate may be deposited under gravity or may be pneumatically conveyed into the chute 11. The aggregate is preferably a loose-fill material, such as discrete elements of an expanded thermoplastic material.

In addition, the machine 10 includes a forming collar 12 disposed about the chute 11 for shaping a continuously supplied strip 13 of netting into a tubular shape about the chute 11 with the longitudinal edges 14,15 of the strip 13 disposed in overlapping relation. The forming collar 12 is of any known suitable type such as that supplied by DSL Forming Collars of Houston, Tex.

Figure 3:
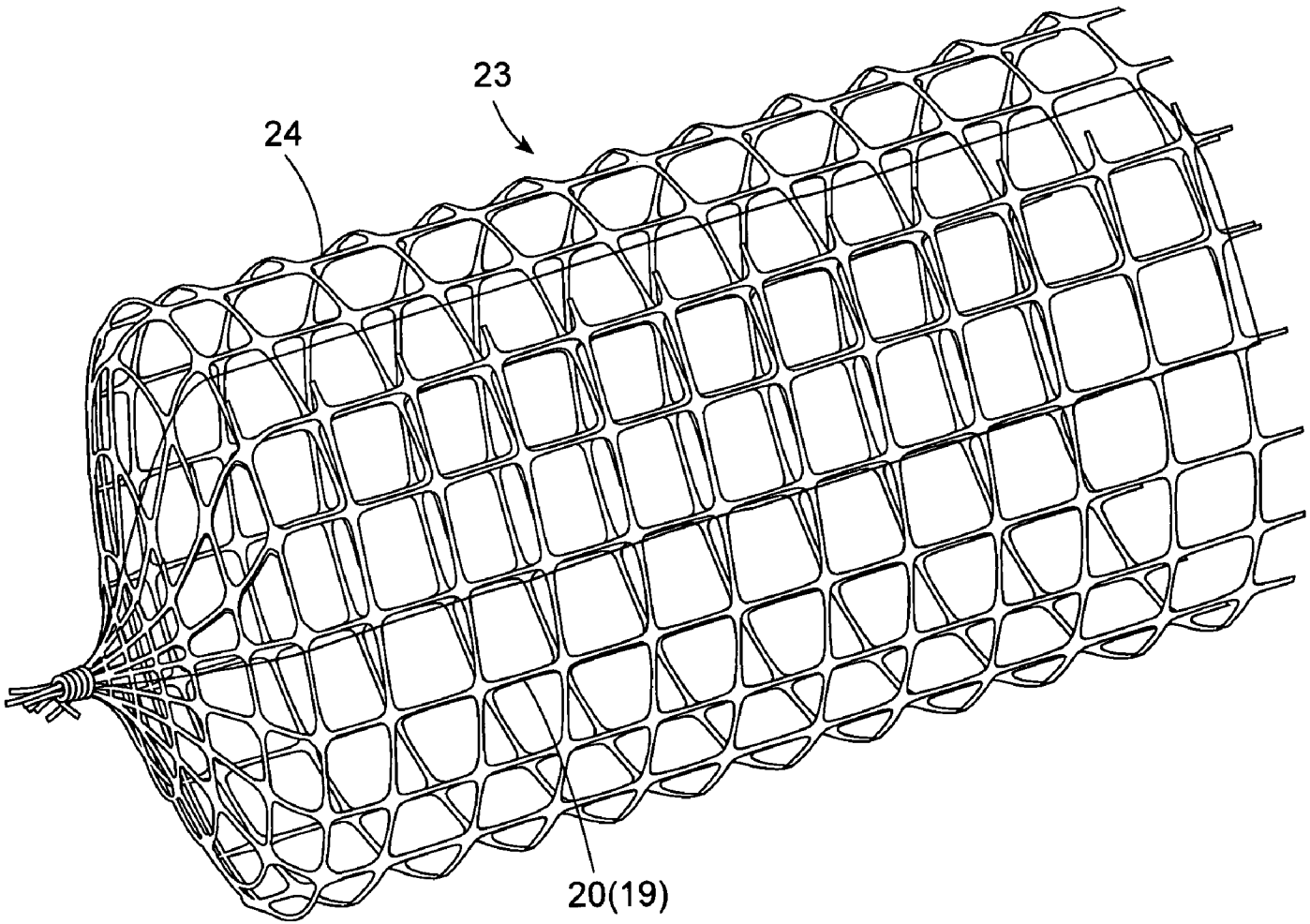
FIG. 3 illustrates a part for perspective view of a tube formed in accordance with the invention.

Referring to FIG. 3, the strip 13 of netting has a square mesh pattern and is formed of individual filaments 16 that bonded together to form the mesh. The netting may be, for example, a polypropylene mesh netting supplied by Conwed of Minneapolis, Minn. under Model No. R01588-033. In this case, the open mesh is approximately ½" square and the filaments have a diameter of approximately 0.010 to 0.125 inches.

During operation of the machine 10, the strip 13 of netting is supplied from a supply spool 17 on a continuous basis to the forming collar 12 so as to be shaped into a tube about the chute 11 in a known manner. The strip 13 is supplied in a width suitable to encompass the diameter of the chute 11 and to provide an overlap of the two edges 14,15 of two inches.

The machine 10 also has a pair of means 18 of any suitable construction for supplying two lengths of tape 19,20, one within the tube of netting and the other outside the tube of netting and both over the overlapped edges 14,15 of the tube of netting. As indicated, the means 18 for supplying the tape 19 for positioning inside of the tube of netting is disposed at a point above the point where the longitudinal edges 14,15 of the strip 13 come together in overlapping relation. The other means 18 for supplying the tape 20 is disposed below that point so as to apply the tape to the outside of the tube of netting.

Each tape 19,20 has an adhesive surface for bonding to the adhesive surface of the other tape. In this respect, the upper tape 19 is supplied so that the adhesive surfaces faces outwardly from the chute 11 while the lower tape 20 is supplied with the adhesive surface facing inwardly of the chute 11 and within the plane of the overlapped edges 14,15 of the strip 13 of netting. The two tapes 19,20 are supplied in facing relation to each other so that the adhesive surfaces of each may be adhered to the other. The width of each tape 19,20 is sufficient to cover the overlapped edges 14,15 of the strip 13 of netting and in the present example, the tapes have a width of 2 inches. The tapes 19,20 may be applied to cover or not the free edge of the strip 13.

The machine 10 is provided with a pair of conveyors 21 on diametrically opposite sides of the chute 11 in order to move the formed tube of netting along the chute 11.

The machine 10 is also provided with a means 22 for pressing the two tapes 19,20 against each other in order to secure the tapes 19,20 together with the overlapped edges 14,15 of the strip 13 of netting sandwiched therebetween, for example, as shown in FIG. 3. In this respect, the adhesive surfaces of the tapes 19,20 are bonded directly to each other within the open meshes of the strip 13 of netting and are also bonded to the opposite sides of the filaments 16 forming the overlapped edges 14,15 of the strip 13 of netting.

The adhesive used on the tapes 19,20 is a pressure sensitive non-releasable type so that the tapes 19,20 may be pressed together to form a secure bond therebetween.

The means 22 of pressing the tapes together may employ a blower (not shown) for blowing a curtain of air through a vertically elongated plenum against the tape 20 on the outside of the tube of netting and towards the chute 11 in order to press the outer tape 20 against the tape 19 on the inside of the tube. The use of air pressure to effect bonding of the two tapes 19,20 together avoids any scribing of the surface of the chute 11 as may be the case if a pressure roller were used to press the tapes 19,20 together. Alternatively, one or more rollers (not shown) may be biased against the chute 11 in order to press the two tapes 19,20 between the rollers and the chute where scribing of the chute 11 is not of concern.

The machine 10 is operated so that the strip 13 of netting is continuously formed into a tube about the chute 11 and moved downwardly off the chute 11 via the conveyors 21 while aggregate is delivered on an intermittent basis through the chute 11 for passage into the formed tube below the outlet of the chute 11. Any suitable valving may be used to interrupt the flow of aggregate into the chute 11 or from the chute 11 during which time a means (not shown) spaced below the chute 11 is operated to gather and secure the netting to form an end of a drainage unit and to contain the aggregate therein, for example in a manner as described in co-pending application Ser. No. 11/106,108 filed Apr. 14, 2005.

The drainage units that are formed may be transported from the machine 10 in a series of linked drainage elements. Alternatively, the drainage units may be separated from each other by cutting through the gathered areas between two adjacent drainage elements.

Figure 4:
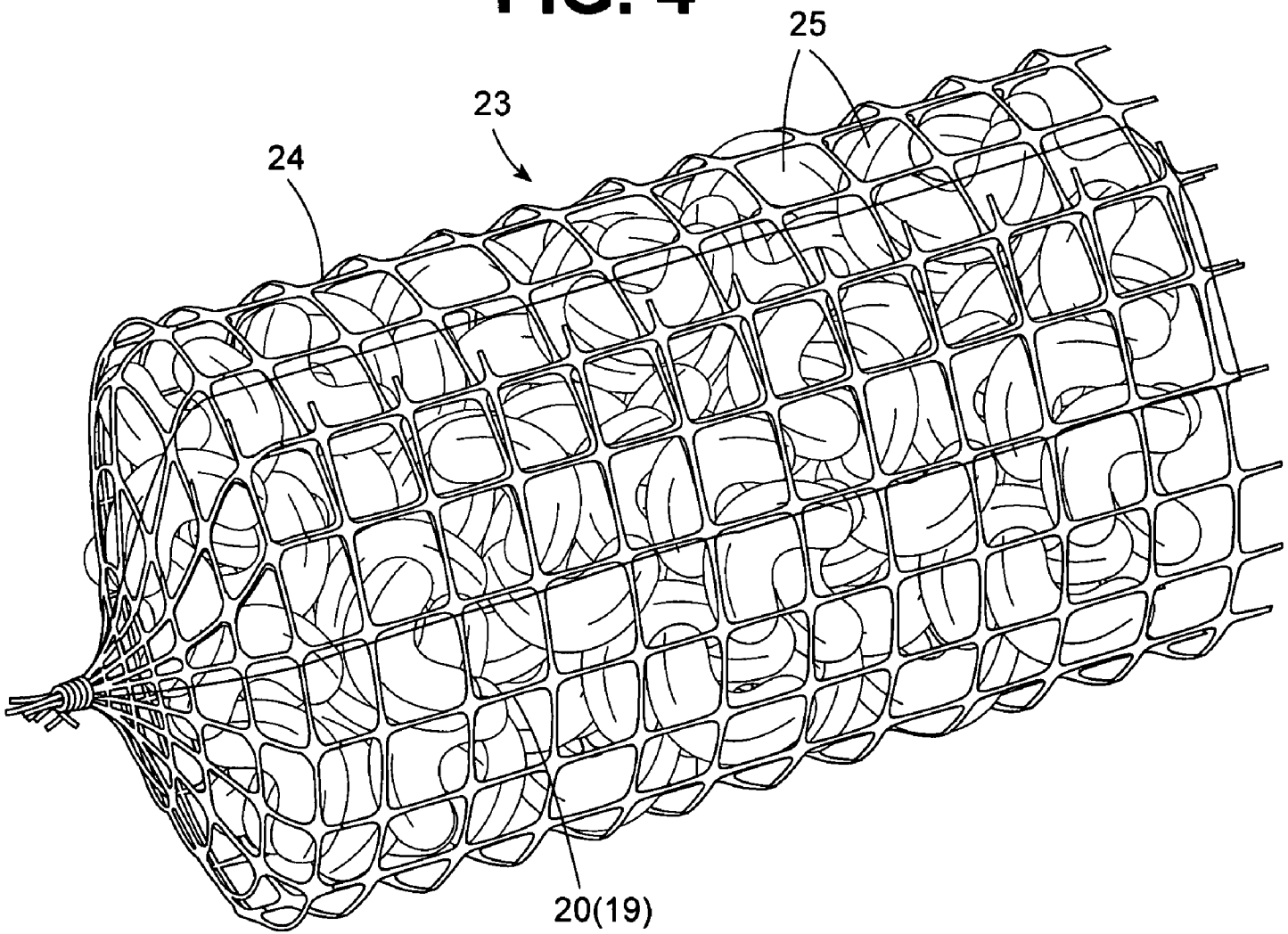
FIG. 4 illustrates a perspective view of a drainage element fabricated from the machine of FIG. 1 in accordance with the invention.

Referring to FIG. 4, wherein like reference characters indicate like parts as above, each drainage element 23 is comprised of a tube 24 of netting with a pair of closed ends and a mass of aggregate 25 within the tube 24. The aggregate is made of discrete elements of a size larger than the mesh openings in the tube 24 in order to be contained therein. In addition, a pair of tapes 19,20 is disposed in opposition to each other longitudinally of the edges of the netting.

The characteristics of the netting are such that the netting is tear resistant. Hence, there is a reduced risk of netting being tom apart by catching on equipment in the field and spilling of the aggregate out of the drainage element. Further, the bonding of the tapes 19,20 together is sufficiently strong so as to be burst-resistant when subjected to forces that would otherwise try to pull the longitudinal ends of the netting apart.

The aggregate may be made of an expanded thermoplastic material that has a residual capacity to expand upon further curing so that when deposited into the netting tube a relatively rigid drainage element is obtained after curing, for example as a manner disclosed in copending patent application Ser. No. 11/248,753 filed Oct. 12, 2005.

The illustrated embodiment shows the chute 11 being disposed on a vertical axis. However, the chute 11 may also be disposed at an angle to the vertical or may be disposed on a horizontal axis.

Because the strip 13 of netting is continuously supplied to the forming collar 12 there is no need to stop the machine 10 in order to resupply a fresh strip of netting. Further, when a supply spool of netting is near exhaustion, a fresh spool may be put into place and the forward end of the fresh spool of netting spliced to the trailing end of the near exhausted spool of netting. Such an operation may also be automated so that the machine may run on a completely automatic basis.

Since the tube of netting is being formed on a continuous basis and being continuously driven over the chute 11 the effective diameter of the netting remains constant throughout the operation of the machine 10. That is to say, there is no necking-down of the netting.

The drainage elements that are formed may be of any suitable diameter. In this respect, the chute 11 may be made of a diameter to suit the diametric size of the drainage element desired. Also, for very large diameter drainage elements, the strip 13 of netting may be made of multiple lengths of netting that are spliced together in parallel relation to provide a greater width of strip. For example, parallel lengths of netting may be spliced by pairs of tapes 14,15 that sandwich the overlapped longitudinal edges of the netting lengths together. Also, the width of the tapes may be varied depending on the size of the drainage element to be made.

Where the cross-section of a drainage element is to be made other than circular, for example, of an oval or elliptical shape, the chute 11 may be made of a complementary shape and the forming collar may be made to form the strip 13 about such a chute.

The drainage elements may also be made with a pipe that is encased within the aggregate and that projects beyond the ends of the tube of netting. One technique for incorporating a pipe in the drainage element is disclosed in the above-identified co-pending patent application Ser. No. 11/106,108.

The strip 13 of netting may also be formed about the chute with the longitudinal edges 14,15 being disposed in different overlapping manners. For example, one edge may be folded over on itself so that the tapes 19,20 sandwich three plies of netting therebetween rather than two plies. Also, the two edges 14,15 may be disposed radially of the chute 11. In this latter case, the tapes 19,20 are applied to the outside of the overlapped edges and pairs of pressing rollers or plates or the like are used to press the tapes together to sandwich the plies of netting therebetween.

The invention thus provides a simple technique for forming drainage elements on a continuous basis.

Further, the invention provides a drainage element that is provided with a tear resistant cover that reduces the risk that the drainage element may be torn open if snagged on equipment in the field.

What is claimed is:

1. A tube comprising a longitudinal strip of netting having a pair of longitudinal edges disposed in overlapping relation to each other to define a tubular cross-section about a longitudinal axis thereof;

a pair of tapes disposed in opposition to each other longitudinally of said strip of netting with said edges of said netting therebetween and bonded to each other to sandwich said edges of said netting therebetween.

2. A tube as set forth in claim 1 further comprising an adhesive bonding said tapes to each other to sandwich said edges of said netting therebetween.

3. A tube as set forth in claim 1 wherein said strip of netting is made of a thermoplastic material.

4. A tube as set forth in claim 1 wherein said edges of said netting are peripherally overlapped relative to each other.

5. A tube as set forth in claim 1 wherein said edges of said netting and said tapes are disposed radially of said tubular cross-section.

6. A tube as set forth in claim 1 wherein at least one of said edges of said netting is folded over on itself between said tapes.

7. A tube as set forth in claim 1 wherein said strip of netting is made of a plurality of parallel sections of netting having longitudinal edges disposed in overlapping relation to an adjacent section and with a pair of tapes secured in opposition to each other with said overlapped edges of said sections secured therebetween.

8. A tuba as set forth in claim 1 further comprising a reinforcing seam securing said edges of said netting together.

9. A tube comprising at least two longitudinal strips of netting, each said strip having a longitudinal edge disposed in overlapping relation to a longitudinal edge of the other of said strips to define at least a peripheral part of a tubular cross-section;

pairs of tapes disposed in opposition to each other longitudinally of said strips of netting, each said pair of tapes having a pair of said overlapped edges therebetween; and an adhesive bonding each said pair of tapes to each other to sandwich said edges of said netting therebetween.

10. A drainage element comprising a strip of netting having a pair of longitudinal edges disposed in overlapping relation to each other to define a tubular cross-section about a longitudinal axis thereof and a pair of closed ends;

a pair of tapes disposed in opposition to each other longitudinally of said netting with said edges of said netting therebetween, said tapes being bonded to each other to sandwich said edges of said netting therebetween; and a mass of aggregate within said netting.

11. A drainage element as set forth in claim 10 further comprising a pipe extending through said mass of aggregate and beyond each end of said netting.

12. A drainage element as set forth in claim 10 further comprising an adhesive bonding said tapes to each other to sandwich said edges of said netting therebetween.

13. A drainage element as set forth in claim 10 wherein said aggregate is loose fill discrete thermoplastic material.

14. A drainage element as set forth in claim 13 wherein said loose fill material is characterized in having been expanded from an initial state to an expanded state after filling of said netting therewith and in imparting a degree of rigidity to the drainage element in said expanded shape sufficient to maintain an expanded three dimensional shape of said netting.

15. A drainage element as set forth in claim 10 wherein said strip of netting is made of a plurality of parallel sections of netting having longitudinal edges disposed in overlapping relation to an adjacent section and with a pair of tapes secured in opposition to each other with said overlapped edges of said sections secured therebetween.

16. A drainage element comprising at least two strips of netting having a pair of longitudinal edges disposed in overlapping relation to each other to define at least one peripheral part of a tubular cross-section about a longitudinal axis thereof and a pair of closed ends;

pairs of tapes disposed in opposition to each other longitudinally of said strips of netting, each said pair of tapes having a pair of said overlapped edges therebetween; and an adhesive bonding each said pair of tapes to each other to sandwich said edges of said netting therebetween; and a mass of aggregate within said netting.

* * * * *